US006688052B1

(12) United States Patent
Flanders

(10) Patent No.: US 6,688,052 B1
(45) Date of Patent: Feb. 10, 2004

(54) NEIGHBORHOOD HOUSING ARRANGEMENT

(76) Inventor: James P. Flanders, 10438 Hwy. 61 South, Vicksburg, MS (US) 39180

( * ) Notice: Subject to any disclaimer, the term of this patent is extended or adjusted under 35 U.S.C. 154(b) by 29 days.

(21) Appl. No.: 10/141,904

(22) Filed: May 8, 2002

(65) Prior Publication Data

(65)

(51) Int. Cl.[7] ..... E02D 19/00
(52) U.S. Cl. ..... 52/169.3; 52/169.2; 52/234
(58) Field of Search ..... 52/169.3, 234, 52/79.1, 169.2

(56) References Cited

U.S. PATENT DOCUMENTS 3,732,649 A * 5/1973 Mehran ..... 52/169.3
4,007,565 A 2/1977 Finnegan ..... 52/169.3
4,575,977 A * 3/1986 Taylor ..... 52/169.3
4,736,556 A 4/1988 Scizak ..... 52/169.2
4,852,313 A 8/1989 Jones ..... 52/169.3
5,469,673 A * 11/1995 Raynor et al. ..... 52/79.7
6,000,192 A * 12/1999 Cohen et al. ..... 52/745.2

* cited by examiner

*Primary Examiner*—Carl D. Friedman
*Assistant Examiner*—Nahid Amiri
(74) *Attorney, Agent, or Firm*—Walker, McKenzie & Walker, PC

(57) ABSTRACT

A Neighborhood Housing Arrangement with a perimeter road to encircle the neighborhood; blocks of residence buildings to have a substantially U-shaped configuration; blocks of residence placed so as to back up to adjoin the perimeter road with the opening of their U-shape facing inward away from the perimeter road; a plurality of residence buildings designed for elderly residents; every residence to enfront a semi-private space such as front porch, deck, balcony, yard, or garden; one block containing the neighborhood center with neighborhood park and a wholesome hangout or gathering building; the undeveloped land to remains in fields; and residence and other buildings to have vehicle access from the rear by either the perimeter road or smaller back streets so residence buildings face a neighborhood interior consisting of parks, fields, sidewalks, and other pedestrian and neighborhood amenities.

9 Claims, 4 Drawing Sheets

NEIGHBORHOOD HOUSING ARRANGEMENT

BACKGROUND OF THE INVENTION

1. Field of the Invention (1) Physically, the present invention lies in the field of knowledge of physical primarily residential neighborhood design, and relates to a physical arrangement of residential buildings in a defined neighborhood.

(2) Functionally, the origins of and intended outcomes from the present invention span other fields of knowledge. A sweeping review of numerous fields of knowledge in the behavioral sciences gave birth to the present invention. The intended results from the present invention (a) include improved satisfaction of basic human needs and thus enhanced quality of life, and (b) lie squarely in the behavioral sciences.

2. Information Disclosure Statement (3) The following patents appear to be relevant to the present invention: Finnegan, U.S. Pat. No. 4,007,565, issued Feb. 15, 1977; Jones, U.S. Pat. No. 4,852,313, issued Aug. 1, 1989; and Scizak, U.S. Pat. No. 4,736,556, issued Apr. 12, 1988.

(4) The Finnegan U.S. Pat. No. 4,007,565 patent discloses an arrangement of dwelling modules in a substantially U-shaped configuration about an auto court, and proposed to enhance motor vehicle convenience for a small cluster of patio homes with vehicle patios in the front and small courtyard patios in the rear of housing modules. The "Abstract of the Disclosure" of the Finnegan U.S. Pat. No. 4,007,565 patent states: "A family dwelling-land development arrangement with a high building-to-land area ratio including a dwelling module comprising a plurality of individual and separate and spaced apart single family dwellings disposed in a substantially U-shaped configuration about an auto court with an open end adequate to accommodate passage of automobiles. The module includes a plurality of automobile shelters adjacent said dwellings and opening to the auto court to accommodate automobiles passing through the opening to the interior of the configuration."

(5) The Jones U.S. Pat. No. 4,852,313 patent discloses "A housing arrangement and method for maximizing the number of houses with a line of sight to a view, with the arrangement comprising a plurality of lots arranged side-by-side adjacent a view and along an imaginary arcuate string line which is connectable to other such string lines along an undulating path to define successive peaks closer to the view and valleys farther from the view, so that all lots thereby have a line of sight to the view, with each lot are preferably each characterized by a building perimeter layout or envelope of predetermined configuration and orientation to enable substantially identical buildings to be placed on all of the lots."

(6) The Scizak U.S. Pat. No. 4,736,556 patent discloses a housing arrangement of closely clustered houses to take maximum advantage of the sun and provide good buffering from annoyances and disturbances. The "Abstract of the Disclosure" of the Scizak U.S. Pat. No. 4,736,556 states: "A housing arrangement in two columns of lots with a staggered configuration such that all the houses in the lots may face in the same direction so as to take advantage of ambient conditions while simultaneously providing optimum land-use efficiency and privacy for the occupants of every lot in their dwellings and back yards. The configuration of structures also provide numerous advantages such as security, noise buffering, avoidance of visual pollution, convenient access to the back yard, ability to change columnar direction to follow the geographic and physical contours of the area, and ease of placement of utility lines and passive solar devices."

(7) Present invention differentiated from three prior patents. Prior patents cited herein reside in the field of building construction either (a) producing physical building outcomes, such as spatial economy of physical building site space (Finnegan U.S. Pat. No. 4,007,565); maximizing solar energy (Scizak U.S. Pat. No. 4,736,556); maximizing the view of other residences from any given residence (Jones U.S. Pat. No. 4,852,313); and optimizing motor vehicle access or traffic (Jones and Scizak Patents) or (b) referring to general behavioral outcomes in the usual manner of the building trades, e.g., "security, . . . avoidance of visual pollution, convenient access to the back yard" (Scizak patent). To their credit, prior patents cited here do set forth a unique combination of features, which comprises more than a list of features from which builders can pick and choose. Never has there been an invention in the present field of invention to: (a) Clearly list and number a finite set of its specific necessary features; (b) arrange those specific numbered necessary features to produce a unique physical Neighborhood Housing Arrangement; (c) make clear reference to selected findings from disciplines including clinical psychology, social psychology, environmental psychology, sociology, urban planning, behavioral architecture, aesthetics, criminology, and traffic engineering with the expressed intent of predicting behavioral outcomes; (d) uniquely synthesize the physical design with multidisciplinary theory and research to produce a neighborhood arrangement to optimize satisfaction of human needs; (e) provide clearly stated links between the physical design and behaviors relating to human need satisfaction; and (f) supply additional detailed specific lists of ancillary (desirable but not necessary) features of physical, financial, social, and research design features to further characterize and thus help distinguish the present invention as unique.

(8) Description of Prior Art (9) The following non-patent references appear to be relevant to the present invention:

(10) Coleman, A. (1990) *Utopia on trial: Vision and reality in planned housing* (2nd ed.). London, England: Hilary Shipman.

(11) Congress for the New Urbanism (2002) *Charter of the new Urbanism*. San Francisco, Calif.: Congress for the New Urbanism. Retrieved Feb. 26, 2002, from http:/cnu.org/cnu_reports/Charter.pdf

(12) Consumer Reports (1996, May) Neighborhoods reborn. *Consumer Reports*, 61(5), 24–30.

(13) Creese, W. L. (1966) *The search for environment: The garden city: Before and after*. New Haven, Conn.: Yale University Press.

(14) Duany, A., & Plater-Zyberk, E. (1992) *Towns and town-making principles*. New York, N.Y.: Rizzoli International.

(15) Eagleton Institute (1987) Desirability of living in different types of communities. (1987) Eagleton Institute of Politics, Rutgers University, cited in "Of settlements and subdivisions . . . " by Harold S. Williams, position paper published by the Rensalaerville Institute. Rensalaerville, N.Y.: Rensalaerville Institute.

(16) Eppli, M. J., & Tu, C. C. (1999) *Valuing the new urbanism: The impact of the new urbanism on prices of single-family homes*. Washington, D. C.: Urban Land Institute.

(17) Flanders, J. P. (1976) Practical psychology. New York, N.Y.: Harper & Row.

(18) Flanders, J. P. (1982) A general systems approach to loneliness. In L. A. Peplau and D. Perlman (Eds.). (pp.166–179). *Loneliness: A sourcebook of current theory, research, and therapy*. New York, N.Y.: Wiley-Interscience.

(19) Howard, E. (1898) *Garden cities of to-morrow*. London, England: Sonnenschein. (Pagination from Faber & Faber 1945 London, England edition)

(20) Jacobs, J, (1961) *The death and life of great American cities*. New York, N.Y.: Random House.

(21) Katz. P. (1994) *The new urbanism: Toward an architecture of community*. New York, N.Y.: McGraw-Hill.

(22) Kunstler, J. H. (1996) *Home from nowhere*. New York, N.Y.: Simon & Schuster.

(23) Miller, J. G. (1978) *Living systems*. New York, N.Y.: McGraw-Hill.

(24) National Crime Prevention Council (2002) Retrieved Sep. 26, 2000, from http//www. Crime Prevention through Environmental Design\NCPC CPTED.htm

(25) Nelessen, A. C. (1994) *Visions for a new American dream*. Chicago, Ill.: Planners Press.

(26) Newman, O. (1973) *Defensible space*. New York, N.Y.: Collier-Macmillan.

(27) Newman, O. (1996, April) *Creating defensible space*. Washington, D.C.: U.S. Department of Housing and Urban Development, Office of Policy Development and Research. (Contract No. DU100C*000005967*, Contractor: Center for Urban Policy Research, Rutgers University.), 31–64.

(28) Newsweek (1995) 15 Ways to fix the suburbs. *Newsweek* (May 15, 1995)

(29) Oldenburg, R. (1989) *The great good place: Cafes, coffee shops, community centers, beauty parlors, general stores, bars, hangouts, and how they get you through the day*. New York, N.Y.: Paragon House.

(30) Parker, B., & Unwin, R. (1901) *The art of building a home*. London, England: Longmans, Green & Co.

(31) Perry, C. A. (1929) The neighborhood unit. In *Neighborhood and community planning, Regional Survey of New York and its environs*, 7, New York, N.Y.: Committee on Regional Plan of New York and Its Environs.

(32) Perry, C. A. (1939) *Housing for the machine age*. New York, N.Y.: Russell Sage Foundation.

(33) Prince of Wales (1989) *A vision of Britain*. New York, N.Y.: Doubleday.

(34) Sierra Club (2002) Sprawl: The dark side of the American dream. Retrieved Feb. 22, 2002, from http://www.sierraclub.org/sprawl/report98/report.asp

(35) Unwin, R. (1909) *Town planning in practice: An introduction to the art of designing cities and suburbs*. London, England: T. Fisher Unwin.

(36) Vermont Forum on Sprawl (2002) Detailed research [on sprawl] Retrieved Mar. 1, 2002 at http://www.vtsprawl.org/index3.htm

(37) Three types of prior art exist in addition to the referenced patents: Village or new urbanism design, sprawl, and neighborhood unit design. Each will be described prior to differentiation from the present invention.

(38) Village or new urbanism design. Village design evolved throughout the ages in the form of vernacular housing built mostly by the residents themselves, presumably to satisfy their needs in the most practical ways. At the dawn of the 20th Century, visionary Ebenezer Howard (1898) founded the Garden City Movement to capture the wisdom and charm of village design. His ideas grew from the 19th Century Arts and Crafts Movement as an alternative to miserable slum living suffered by the factory workers in Britain. Howard aimed to create a Utopian a socialist society, and as architects he chose Sir Raymond Unwin (1909) and Barry Parker (Parker & Unwin, 1901)—and they stole the conceptual show. Unwin and Parker so brilliantly created charming towns and houses; lobbied Garden City features into public housing practices; and led the way toward officially recognized schools of urban planning in Britain, Europe, and the United States, that the original socialist focus for The Garden City Movement was all but forgotten and replaced by Unwin and Parker's images of picturesque villages. Village or Garden City or traditional or Small Town USA style reigned supreme in Europe and the United States until just after World War II, when sprawl design took over. Beginning in the mid-1980s as a reaction against sprawl design, architects Andres Duany and Elizabeth Plater-Zyberk (1992) founded a movement to replace sprawl known as the "new urbanism" or "neotraditional" design that touted the virtues of and resurrected Garden City design. New urbanist planners have used Raymond Unwin's major statement, *Town Planning in Practice* (1909), as their primary design reference. They have founded schools, written extensively, and gained support with both scholars and homebuyers seeking to live in a traditional neighborhood. At the dawn of the 21st Century over 200 new urbanism housing projects were under construction, and many more estimated to be in the planning stages. For consideration in this document, village and new urbanism design will be considered one and the same, because both (a) make general reference to human values and needs and (b) supply lists of design features. Duany and Plater-Zyberk (1992) have defined 13 characteristics of the traditional neighborhood. *Newsweek* magazine (1995) published 15 ways -to fix the suburbs. Planner Anton Clarence Nelessen (1994) pursued an empirical research approach and developed his principles using his Visual Preference Survey™ technique. In this technique respondents rate pictures he shows to identify preferred arrangements of the built environment. Nelessen (1994) listed ten basic design principles to create small communities actually desired by his research subjects, who invariably preferred village design. *The Charter of the Congress for the New Urbanism* (2002) was drafted by a who's who in the new urbanism design community and spelled out 27 specific design features to guide American urban growth. Britain's Prince Charles of Wales (1989) has vigorously condemned sprawl and propounded his own Ten Design Principles (Prince of Wales, 1989, pp. 75–153) for village or new urbanism design.

(39) Summary list of new urbanism features. All the new urbanism features in the lists cited in the paragraph just preceding can be summarized as follows: (1) The overarching principle: Planned in advance; (2) Has a discernable center such as a square or green; (3) Residences lie within five minute walk of the center; (4) Buildings and residents vary, are not highly homogeneous; (5) Mixed use is allowed and encouraged; (6) Outbuildings are allowed and encouraged; (7) An elementary school is accessible; (8) Playgrounds lie near dwellings; (9) Streets form a connected network; (10) Streets are narrow and pretty; (11) Buildings lie close to the street, so setbacks are small; (12) Parking is to the rear of buildings accessible by alley; (13) Civic buildings lie at the most prominent sites; (14) Neighborhood is to some degree self-governing; (15) Neighborhood lies close to jobs; (16) Neighborhood has an edge; (17) Neighborhood emphasizes pedestrian traffic over vehicle traffic; (18) Neighborhood design emphasizes preserving nature; (19) Lawns are relatively small; (20) Few cul-de-sacs; (21) Design is at human or pedestrian scale, not large scale; (22) Buildings should have some decoration and be pretty; (23) The users of buildings are consulted prior to final design; and (24) Buildings are of American traditional design.

(40) Sprawl design—During World War II, William Levitt perfected highly efficient methods of manufacturing housing with specialized work crews and prefabricated components. After World War II, the combination of new home manufacturing efficiencies and rising availability of the automobile provided the means for millions of Americans to realize the American Dream of their own single family detached house using a vehicle-friendly neighborhood design known universally as suburban sprawl or "sprawl" for short. As the design for the spectacularly influential Levittown, sprawl has dominated new housing neighborhood arrangements ever since that time, often codified in countless zoning ordinances as the only design permitted. Ever since World War II, sprawl has enjoyed both (a) condemnation by most scholars (e.g., Kunstler, 1996) and (b) commercial domination of the marketplace.

(41) The Sierra Club (2002) definition of sprawl: Sprawl is low-density development beyond the edge of service and employment, which separates where people live from where they shop, work, recreate, and educate—thus requiring cars to move between zones.

(42) Duany and Plater-Zyberk's characteristics of suburban sprawl: Sprawl is disciplined only by isolated "pods," which are dedicated to single uses such as "shopping centers," "office parks," and "residential clusters." All of these are inaccessible from each other except by car. Housing is strictly segregated in large clusters containing units of similar cost, hindering socioeconomic diversity. Sprawl is limited only by the range of the automobile, which easily forms catchments. Areas for retail often require travel exceeding 50 miles. There is a high proportion of cul-de-sacs and looping streets "dead worm" design. Through traffic is possible only by means of a few "collector" streets, which become easily congested. Vehicular traffic controls the scale and form of space with streets being wide and dedicated primarily to the automobile. Parking lots typically dominate the public space. Buildings are often highly articulated, rotated on their lots, and greatly set back from streets. Buildings are thus unable to create spatial definition or sense of place. Civic buildings do not normally receive distinguished sites. Open space is often provided in the form of "buffers," "pedestrian ways," "berms," and other ill-defined residual spaces.

(43) Researchers studying sprawl in Vermont (Vermont Forum on Sprawl, 2002) defined sprawl as low-density development outside compact urban and village centers along highways and in rural countryside. When asked about what features make up sprawl, citizens reported: commercial development strung out along a highway; increased amount of paved areas; more roads and parking; single family homes spread out on former farm fields; widely spaced development with a scattered appearance; and development that requires an automobile. The researchers in Vermont identified the following characteristics of sprawl: Excessive land consumption by development on unnecessarily large lots that waste productive farm and forest land; low average densities in comparison to existing centers; development that requires an auto for access; fragmented open space; wide gaps between development and a scattered appearance; separation of uses into distinct areas; premature extension of public services to serve the development before other areas are filled; lack of economic and social diversity in residential areas; lack of public spaces and community centers; repetitive, large "box" buildings with no distinctive character; and large paved areas—wide roads, more roads, and large parking areas. The Vermont researchers found the following indicators of presence of sprawl: Scattered residential lots in outlying areas; residential subdivisions on oversized lots near town centers; planned housing developments in outlying areas; commercial strip development; other commercial and industrial areas that have large lots and inefficient layout; and peripheral location of public buildings.

(44) Present invention differentiated from new urbanism and sprawl design prior art. Nothing in the known prior art, either singly or in combination, discloses or suggests the present invention which (a) clearly lists and numbers a finite set of its specific necessary features; (b) arranges those specific numbered necessary features to produce a unique physical Neighborhood Housing Arrangement; (c) makes clear reference to selected findings from disciplines including clinical psychology, social psychology, environmental psychology, sociology, urban planning, behavioral architecture, aesthetics, criminology, and traffic engineering with the expressed intent of predicting behavioral outcomes; (d) uniquely synthesizes the physical design with multidisciplinary theory and research to produce a neighborhood arrangement to optimize satisfaction of human needs; (e) provides clearly stated links between the physical design and behaviors relating to human need satisfaction; and (f) supplies additional detailed specific lists of ancillary (desirable but not necessary) features of physical, financial, social, and research design features to further characterize and thus help distinguish the present invention as unique. In contrast to the present invention, the essence of both new urban and sprawl design is simply specified in lists of features from which builders pick and choose. In contrast to the present invention, new urbanism or sprawl design can result in (this list parallels the earlier list in this paragraph): (a) Employment of any combination of physical design features from a long list; (b) siting the housing in a wide variety of permissible arrangements, not a unique physical housing arrangement; (c) omitting any reference to related scholarly fields of knowledge; (d) omitting any effort to synthesize physical design with multidisciplinary theory and research; (e) omitting any linkages between physical design and behaviors relating to satisfaction of human needs; and (f) failing to include or even mention additional detailed specific lists of ancillary (desirable but not necessary) features of physical, financial, social, and research design. New urbanism and sprawl are fields of design, not a specific design such as the present invention. Other unique housing arrangements which accomplish the first listing (a)–(f) in this paragraph are certainly possible and will hopefully appear over time, but the present invention is the first one.

(45) The neighborhood unit design of Clarence Perry. Planner Clarence Perry wrote a classic paper (Perry, 1929) defining the "neighborhood unit" and later updated his thinking in a book (Perry, 1939) *Housing for the Machine Age*. His neighborhood unit "consists of six principles" (1939, p. 51): (1) Size to support an elementary school, generally a half mile in diameter at most, (2) boundaries on all sides by arterial streets, (3) open spaces for small parks and recreation of about 10% of the total neighborhood area, (4) institutions such as schools, community centers, and churches grouped around a central point, (5) local shops around the circumference at traffic junctions, and (6) internal street system with lots of cul-de-sacs and street widths sized to facilitate internal traffic and discourage through traffic. Perry intended his hugely influential neighborhood unit to satisfy most needs of residents and bring the advantages of traditional small town living into the city. In actual practice, progress on (a) government regulations needed to implement Perry's concept and (b) building the acclaimed new town of Radburn, N.J., were both stopped dead in their tracks by the economic catastrophe of the Great Depression and never recovered. A few of Perry's principles were implemented in British new towns. Since the time of Perry's seminal writings, his six principles have suffered curious fates, some actually fueling the prevalence of sprawl: (1) School systems and bussing of students spread out so much and change so often that building a neighborhood around schools has become generally unfeasible; (2) Arterial streets have become the central conceptual basis for sprawl; (3) Lax zoning has made the inclusion of open spaces optional, so most sprawl design housing has none or 0%, let alone 10%, of total area in open space; (4) Easy automobile travel and market forces have led to siting of institutions such as schools, community centers, and churches at locations of convenience for vehicle traffic, not pedestrian traffic; (5) Local shops have long since largely given way to much larger shopping centers; and (6) Residential streets in sprawl design almost totally embrace winding cul-de-sac patterns but are zoned so wide as to all but destroy any semblance of Perry's original concept, even if it has all its five prior principles intact.

(46) Present invention differentiated from Perry's neighborhood unit. The present invention has a perimeter road that is actually separated from arterial roads outside the Neighborhood Housing Arrangement. The present invention has open space, but it is uniquely situated. Otherwise the present invention has little in common with Perry's neighborhood unit concept other than Perry's general intent to better meet human needs. Nothing in the Perry's neighborhood unit, either singly or in combination, discloses or suggests the present invention which (a) clearly lists and numbers a finite set of its specific necessary features; (b) arranges those specific numbered necessary features to produce a unique physical Neighborhood Housing Arrangement; (c) makes clear reference to selected findings from disciplines including clinical psychology, social psychology, environmental psychology, sociology, urban planning, behavioral architecture, aesthetics, criminology, and traffic engineering with the expressed intent of predicting behavioral outcomes; (d) uniquely synthesizes the physical design with multidisciplinary theory and research to produce a neighborhood arrangement to optimize satisfaction of human needs; (e) provides clearly stated links between the physical design and behaviors relating to human need satisfaction; and (f) supplies additional detailed specific lists of ancillary (desirable but not necessary) features of physical, financial, social, and research design features to further characterize and thus distinguish the present invention as unique.

(47) Housing choices at the dawn of the 21st Century. At the dawn of the 21st Century, most residents who wish to maximize quality of life by living in a healthy neighborhood surrounded by beauty face severely and frustratingly limited choices. On the one hand, most people in the U.S. report on surveys (Eagleton Institute, 1987) they would prefer to live in a small town versus any other arrangement, and they rate village photographs desirable and photographs of sprawl as undesirable (Nelessen, 1994). On the other hand, housing choices remain dominated by sprawl design. Homebuyers who can afford it increasingly choose new urbanism design and pay 11% in actual sales price (Eppli & Tu, 1999). With about with 200 new urbanism design projects under construction (Eppli & Tu, 1999), new urbanism design is available only in relatively few and upscale neighborhoods-out of reach of the average homebuyer (*Consumer Reports*, 1996).

(48) Optimizing versus maximizing satisfaction of human needs. To understand the present invention one needs to note the important distinction between "optimizing" and "maximizing" of human needs. Optimizing means best overall need satisfaction. Maximizing means the very highest level of satisfaction. Optimizing usually requires getting a high but not the highest possible satisfaction for a set or combination of needs. For example, if safety need satisfaction were maximized, residence buildings in a neighborhood might be surrounded by moats and tall electrified barbed wire fences, but satisfaction of needs for socialization with neighbors as well as need for peace and beauty would suffer. Therefore, the overall optimizing of needs in the present invention necessarily refers to the joint outcome upon satisfying a set or combination of human needs: Safety, privacy, peace and beauty, and socialization (Flanders, 1976, Ch.5).

BRIEF SUMMARY OF THE INVENTION

(49) A Neighborhood Housing Arrangement to maximize the quality of life by optimizing the satisfaction of basic human needs for safety, privacy, peace and beauty, and socialization within household members and between members of different households throughout the neighborhood by encircling the neighborhood with a perimeter road; blocks of residence buildings to have a substantially U-shaped configuration; blocks of residence buildings placed so as to back up to adjoin the perimeter road with the opening of their U-shape facing inward away from the perimeter road; a plurality of residence buildings to be designed for elderly residents to guarantee a viable presence of three generations of residents; every residence to enfront a semiprivate space such as front porch, deck, balcony, yard, or garden; one block containing the neighborhood center with neighborhood park and a wholesome hangout or gathering building such as general store, coffee house, or soda shop; the undeveloped land to remain in fields; and residence and other buildings to have vehicle access from the rear by either the perimeter road or smaller back streets so residence buildings face a neighborhood interior with no roads or vehicles but rather consisting of parks, fields, sidewalks, and other pedestrian and neighborhood amenities.

BRIEF DESCRIPTION OF THE SEVERAL VIEWS OF THE DRAWINGS

(50)

(51)

(52)

(53)

DETAILED DESCRIPTION OF THE INVENTION

Figure 1:
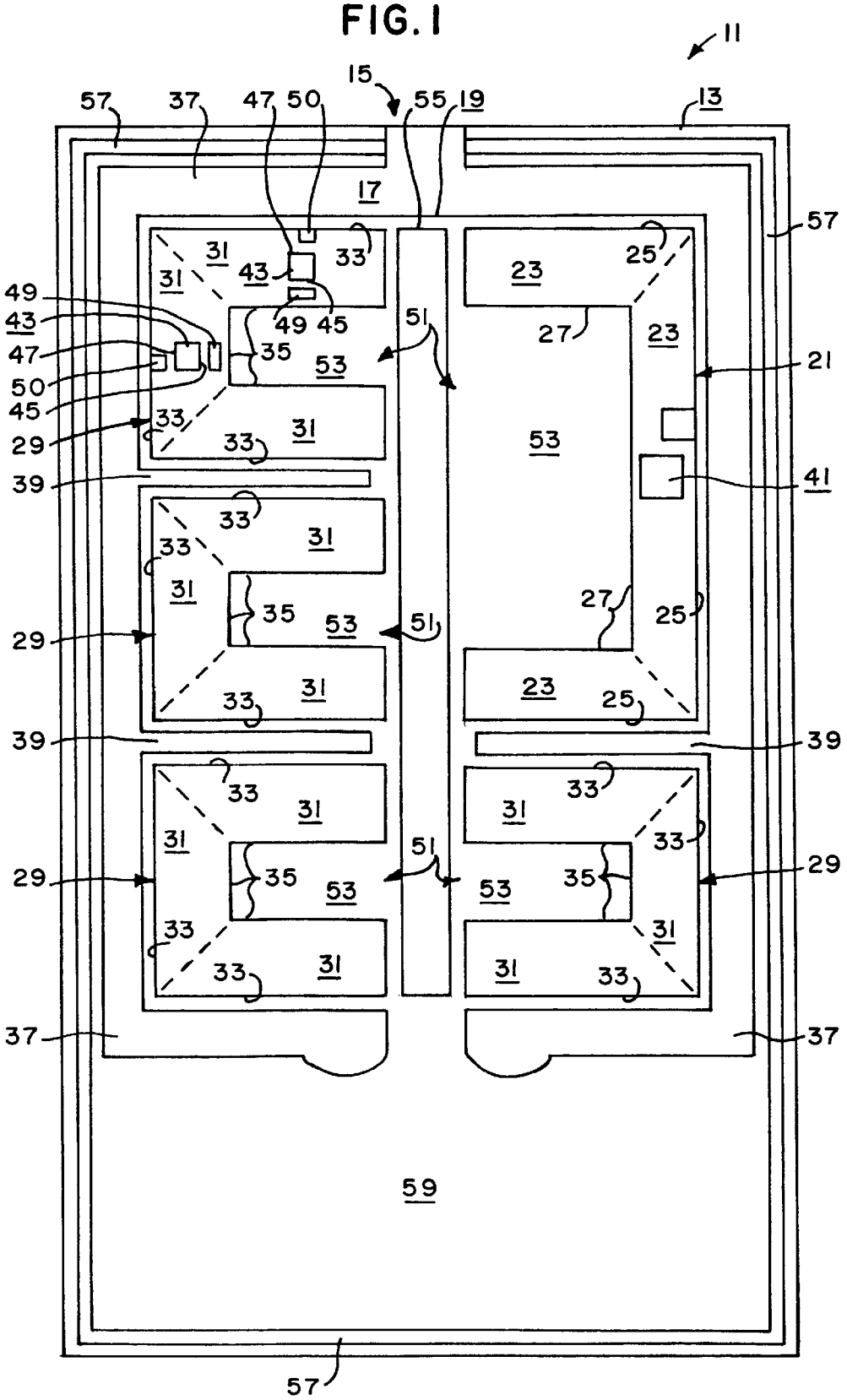
FIG. 1 is a schematic, less detailed plan view of the preferred embodiment archetype of the Neighborhood Housing Arrangement of the present invention showing its major features.

(54) Preferred embodiment of the invention shown in FIGS. 1–4. A first preferred embodiment of the Neighborhood Housing Arrangement of the present invention is shown schematically in FIG. 1, and identified by the numeral 11. The Neighborhood Housing Arrangement 11 includes a neighborhood tract 13 having an entrance 15; a road 17 within the neighborhood tract 13 extending from the entrance 15 of the neighborhood tract 13; a neighborhood park 19 within the neighborhood tract 13; a neighborhood center block 21 within the neighborhood tract 13, the neighborhood center block 21 including a plurality of neighborhood center block building lots 23, each of the neighborhood center block building lots 23 having a rear border 25 adjacent the road 17 and having a front border 27 adjacent the neighborhood park 19; and at least one and preferably a plurality of residence blocks 29 within the neighborhood tract 13, each residence block 29 including a plurality of residence block building lots 31, each of the residence block building lots 31 having a rear border 33 adjacent the road 17 and having a front border 35 adjacent the neighborhood park 19. The road 17 preferably includes a perimeter road 37 extending from the entrance 15 of the neighborhood tract 13 around at least a portion of the perimeter of the neighborhood tract 13, and one or more back streets 39 extending from the perimeter road 37 to the rear border 25, 33 of any of the neighborhood center block building lots 23 and/or residence block building lots 31 that is not adjacent the perimeter road 37. The Neighborhood Housing Arrangement 11 preferably. includes a neighborhood center 41 on at least one of the neighborhood center block building lots 23, and a residence building 43 on at least one of the residence block building lots 31. The residence building 43 preferably has a front side 45 adjacent the front border 35 of the residence block building lot 31, a rear side 47 adjacent the rear border 33 of the residence block building lot 31, and a semi-private space 49 adjacent the front side 45 thereof. Each of the residence block building lot 31 preferably has vehicle access area 50, and the vehicle access area 50 is preferably limited to the rear border 33 of the respective residence block building lot 31. The residence block 31 is arranged to have a substantially U-shaped configuration with an opened mouth 51, and the neighborhood park 19 may include a peninsular-like area 53 extending into the opened mouth 51 of the U-shaped residence block 29. The neighborhood park 19 preferably includes a pedestrian promenade 55 joining each of the neighborhood center and residence blocks 21, 29. The pedestrian promenade 55 may include sidewalks, "footpaths," etc., extending past the front side 45 of each residence building 43 for linking the neighborhood interior. The Neighborhood Housing Arrangement 11 may include a privacy barrier 57, such as a fence, hedge, etc., extending around the perimeter of the neighborhood tract 13. All undeveloped land in the neighborhood tract 13 is preferably left as open fields 59.

Figure 2:
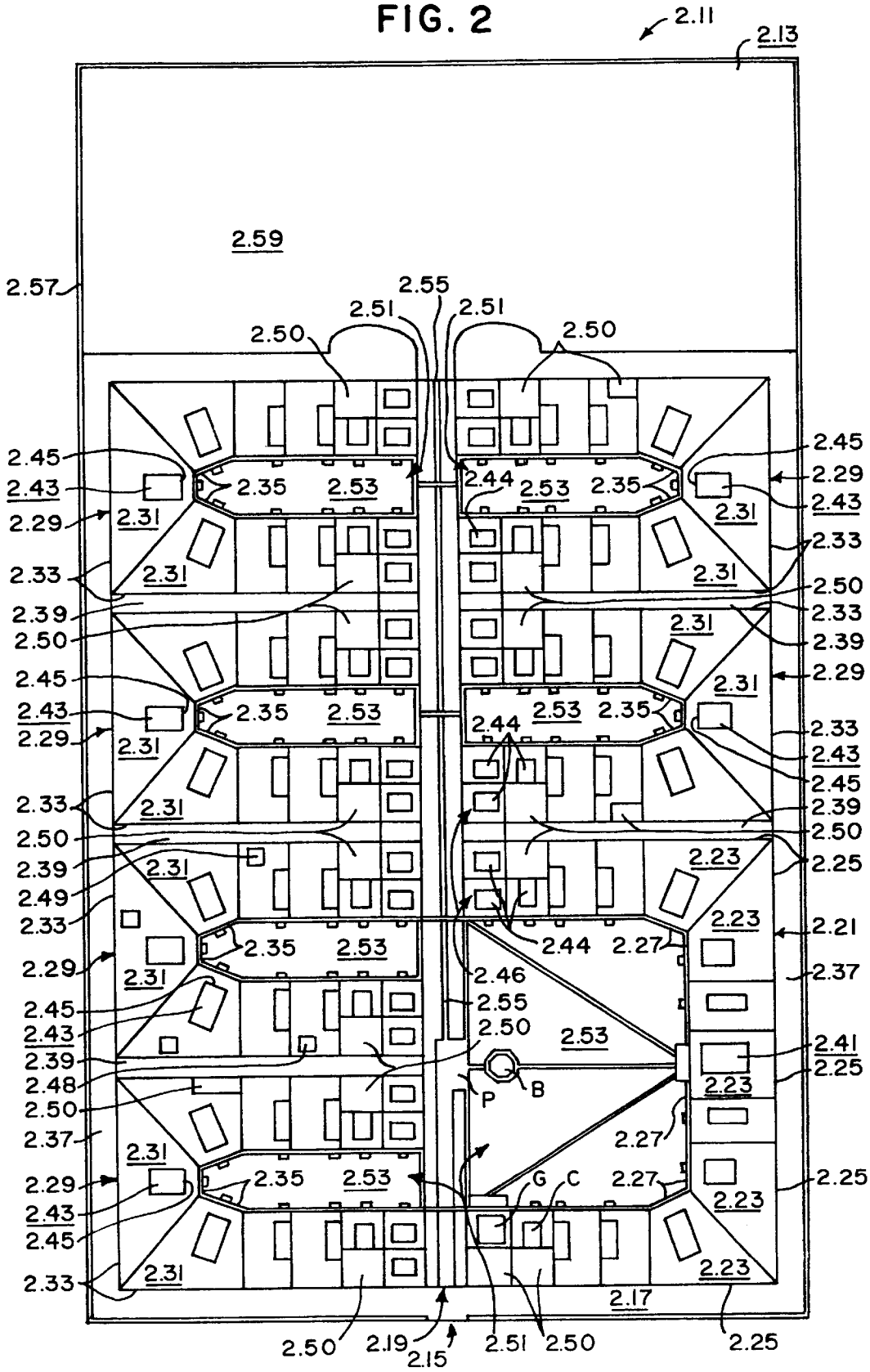
FIG. 2 is a detailed prototype plan view of the same embodiment of the Neighborhood Housing Arrangement of the present invention sited on ideal terrain that is perfectly flat.

(55) A second preferred embodiment of the Neighborhood Housing Arrangement of the present invention is shown in detail diagrammatically in FIG. 2, and identified by the numeral 2.11. The basic design features of the Neighborhood Housing Arrangement 2.11 are similar to or the same as that of the Neighborhood Housing Arrangement 11, and like features of the Neighborhood Housing Arrangement 2.11 are identified by the same numeral used herein for the Neighborhood Housing Arrangement 11 but with the added prefix "2." as will now be apparent to those skilled in the art. Thus, for example, the Neighborhood Housing Arrangement 2.11 preferably includes a neighborhood tract 2.13 having an entrance 2.15; a road 2.17 within the neighborhood tract 2.13 extending from the entrance 2.15 of the neighborhood tract 2.13; a neighborhood park 2.19 within the neighborhood tract 2.13; a neighborhood center block 2.21 within the neighborhood tract 2.13, the neighborhood center block 2.21 including a plurality of neighborhood center block building lots 2.23, each of the neighborhood center block building lots 2.23 having a rear border 2.25 adjacent the perimeter road 2.17 or back street 2.39 and having a front border 2.27 adjacent the neighborhood park 2.19; at least one and preferably a plurality of residence blocks 2.29 within the neighborhood tract 2.13, each residence block 2.29 including a plurality of residence block building lots 2.31, each of the residence block building lots 2.31 having a rear border 2.33 adjacent the road 2.17 and having a front border 2.35 adjacent the neighborhood park 2.19; at least one and preferably a plurality of residence buildings 2.43 on at least one of the residence block building lots 2.31, each residence building 2.43 preferably has a front side 2.45 adjacent the front border 2.35 of the residence block building lot 2.31; and a plurality of residences for the elderly 2.44 occupying a prominent position facing and lining a pedestrian promenade 2.55. The residences for the elderly 2.44 may be grouped in clusters 2.46. The pedestrian promenade 2.55 may include sidewalks, "footpaths," etc., extending past the front side 2.45 of each residence building 2.43, etc., for linking the neighborhood interior. Various common parking areas 2.50 may be provided at the rear of the neighborhood center block 2.21 and/or one or more residence blocks 2.29. The exact position of buildings 2.41 and 2.43, etc., in the lots 2.21 and 2.23 is not a central feature of any preferred embodiment and shall be determined by local conditions of terrain, land cost, zoning regulations, and other outside factors governing the Neighborhood Housing Arrangement 2.11.

Figure 3:
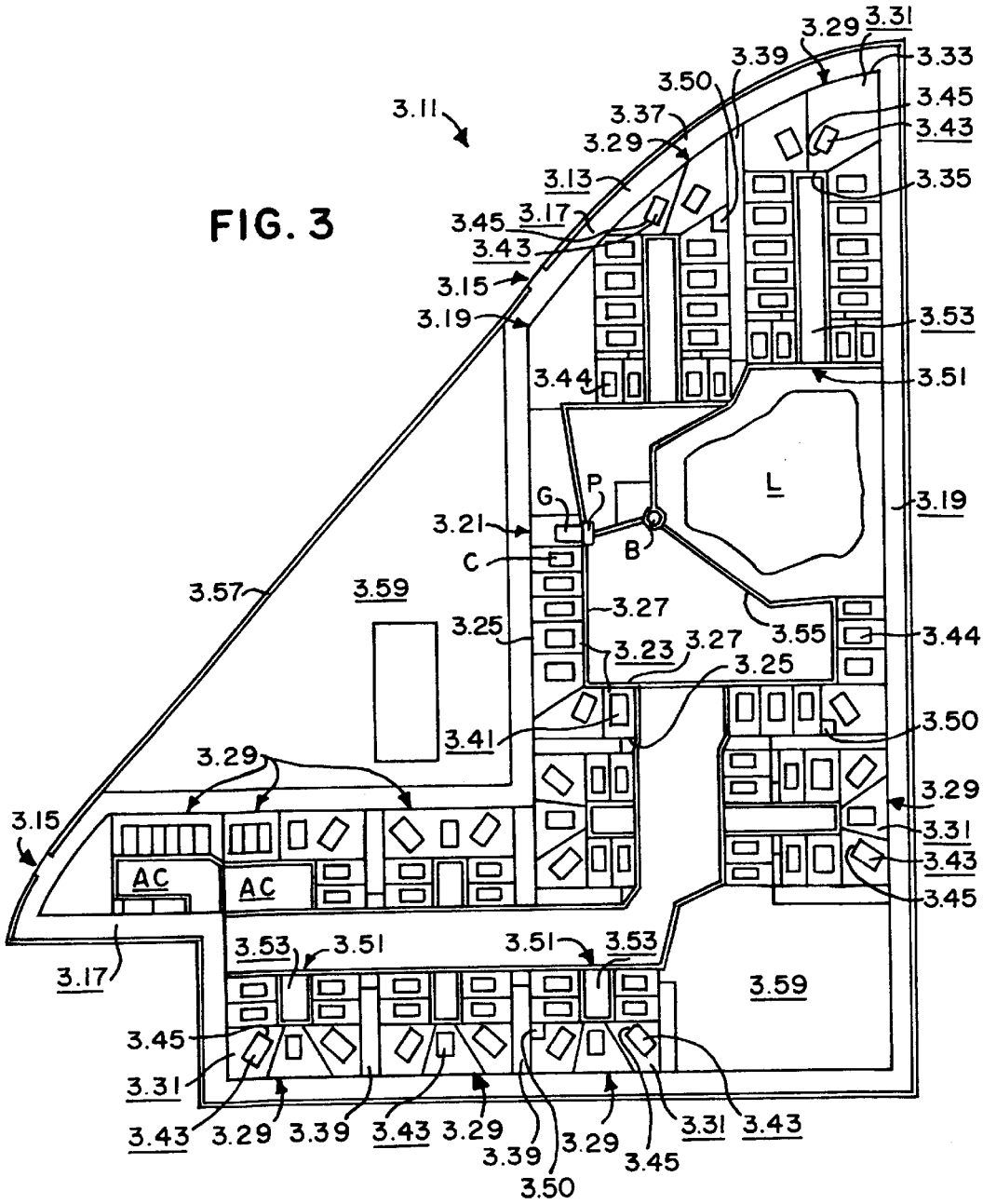
FIG. 3 is a detailed plan view of a prototype embodiment of the Neighborhood Housing Arrangement of the present invention with the building site in the form of a sideways "L," an existing lake, and a busy two-lane road defining the diagonal western border slanting from Southwest to Northeast.

(56) A third preferred embodiment of the Neighborhood Housing Arrangement of the present invention is shown in detail diagrammatically in FIG. 3, and identified by the numeral 3.11. The basic design features of the Neighborhood Housing Arrangement 3.11 are similar to or the same as that of the Neighborhood Housing Arrangement 11, and like features of the Neighborhood Housing Arrangement 3.11 are identified by the same numeral used herein for the Neighborhood Housing Arrangement 11 but with the added prefix "3." as will now be apparent to those skilled in the art. Thus, for example, the Neighborhood Housing Arrangement 3.11 preferably includes a neighborhood tract 3.13 having an entrance 3.15; a road 3.17 within the neighborhood tract 3.13 extending from the entrance 3.15 of the neighborhood tract 3.13; a neighborhood park 3.19 within the neighborhood tract 3.13; a neighborhood center block 3.21 within the neighborhood tract 3.13, the neighborhood center block 3.21 including a plurality of neighborhood center block building lots 3.23, each of the neighborhood center block building lots 3.23 having a rear border 3.25 adjacent the perimeter road 3.17 or back street 3.39 and having a front border 3.27 adjacent the neighborhood park 3.19; at least one and preferably a plurality of residence blocks 3.29 within the neighborhood tract 3.13, each residence block 3.29 including a plurality of residence block building lots 3.31, each of the residence block building lots 3.31 having a rear border 3.33 adjacent the road 3.17 and having a front border 3.35 adjacent the neighborhood park 3.19; at least one and preferably a plurality of residence building 3.43 on at least one of the residence block building lots 3.31, each residence building 3.43 preferably has a front side 3.45 adjacent the front border 3.35 of the residence block building lot 3.31; and a plurality of residences for the elderly 3.44 occupying a prominent position facing and lining a pedestrian promenade 3.55. The pedestrian promenade 3.55 may include sidewalks, "footpaths," etc., extending past the front side 3.45 of each residence building 3.43, etc., for linking the neighborhood interior. Various common parking areas 3.50 may be provided at the rear of the neighborhood center block 3.21 and/or one or more residence blocks 3.29. As shown in FIG. 3, the neighborhood tract 3.13 may include a lake L.

Figure 4:
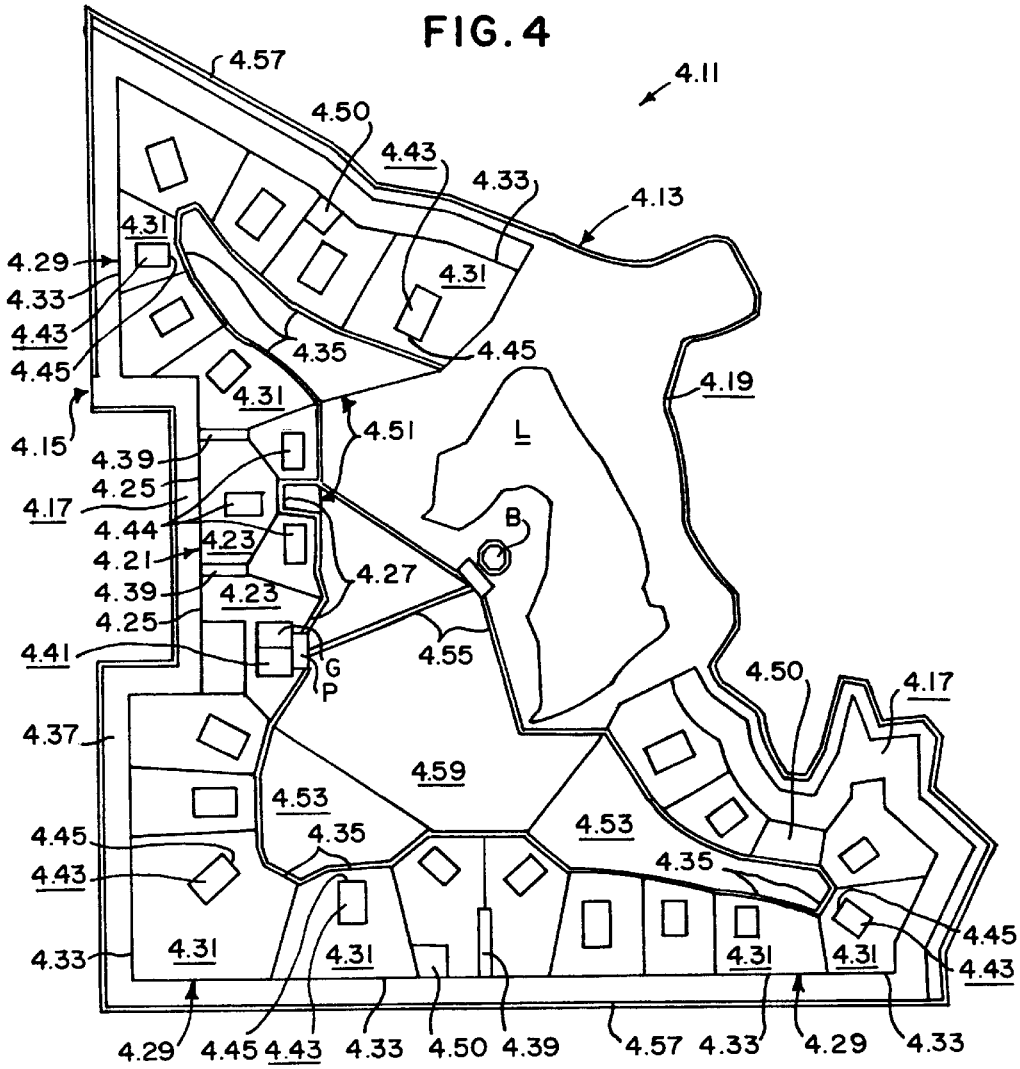
FIG. 4 is a detailed plan view of another prototype embodiment of the Neighborhood Housing Arrangement of the present invention with a lake, and is bounded on the South and West by straight lines and on the North and East by a creek that curves around with a highly irregular course.

(57) A fourth preferred embodiment of the Neighborhood Housing Arrangement of the present invention is shown in detail diagrammatically in FIG. 4, and identified by the numeral 4.11. The basic design features of the Neighborhood Housing Arrangement 4.11 are similar to or the same as that of the Neighborhood Housing Arrangement 11, and like features of the Neighborhood Housing Arrangement 4.11 are identified by the same numeral used herein for the Neighborhood Housing Arrangement 11 but with the added prefix "4." as will now be apparent to those skilled in the art. Thus, for example, the Neighborhood Housing Arrangement 4.11 preferably includes a neighborhood tract 4.13 having an entrance 4.15; a road 4.17 within the neighborhood tract 4.13 extending from the entrance 4.15 of the neighborhood tract 4.13; a neighborhood park 4.19 within the neighborhood tract 4.13; a neighborhood center block 4.21 within the neighborhood tract 4.13, the neighborhood center block 4.21 including a plurality of neighborhood center block building lots 4.23, each of the neighborhood center block building lots 4.23 having a rear border 4.25 adjacent the perimeter road 4.17 or back street and having a front border 4.27 adjacent the neighborhood park 4.19; at least one and preferably a plurality of residence blocks 4.29 within the neighborhood tract 4.13, each residence block 4.29 including a plurality of residence block building lots 4.31, each of the residence block building lots 4.31 having a rear border 4.33 adjacent the road 4.17 and having a front border 4.35 adjacent the neighborhood park 4.19; at least one and preferably a plurality of residence building 4.43 on at least one of the residence block building lots 4.31, each residence building 4.43 preferably has a front side 4.45 adjacent the front border 4.35 of the residence block building lot 4.31; and a plurality of residences for the elderly 4.44 occupying a prominent position facing and lining a pedestrian promenade 4.55. The pedestrian promenade 4.55 may include sidewalks, "footpaths," etc., extending past the front side 4.45 of each residence building 4.43, etc., for linking the neighborhood interior. As shown in FIG. 4, the neighborhood tract 4.13 may include a lake L.

I. Eight basic physical design features listed—The present invention's basic eight physical design features are all preferably present unless prohibited by terrain or law. For purposes of patent these physical features contain the essence of, are sufficient to define the preferred embodiment of, and produce the present invention. These basic physical design features will be discussed in detail in the remainder of this document.

(59) The present invention's basic physical design features consist of a Neighborhood Housing Arrangement with: (1) A perimeter road around the outside border of the residential part of the neighborhood; (2) Blocks of residence buildings having a substantially U-shaped configuration surrounding and forming the outside boundary of a block park; (3) Blocks of residence buildings placed so as to back up to adjoin the perimeter road with the opening of their U-shape facing inward away from the perimeter road; (4) A plurality of residence buildings designed for elderly residents to guarantee a viable presence of three generations of residents; (5) Every residence enfronting a semi-private space such as front porch, deck, balcony, yard, or garden; (6) One block containing the neighborhood center with neighborhood park and a wholesome hangout or gathering building such as general store, coffee house, or soda shop; (7) Undeveloped land remaining in fields; and (8) Residence and other buildings having vehicle access from the rear by either the perimeter road or smaller back streets so residence buildings face a neighborhood interior with no roads or vehicles but rather consisting of parks, fields, sidewalks, and other pedestrian and neighborhood amenities.

(60) Seven ancillary physical design features. Ancillary physical design features of the present invention are preferably all present unless prohibited by terrain, law, or financial cost. For purposes of patent these ancillary physical design features contain added amenities falling outside the essence and definition of the preferred embodiment of the present invention to be discussed in this document. Thus the ancillary physical design features will not be discussed in detail in this document. These ancillary physical design features consist of a Neighborhood Housing Arrangement with the following neighborhood community amenities: (1) Wholesome hangout for socialization including members of three generations of residents, such as General Store, coffee house, soda fountain shop, or other of similar utility, labeled G in FIGS. 2–4; (2) Bandstand or gazebo ("bandstand" for short) at least two feet in diameter for every residence up to a maximum diameter of 30 feet, labeled B in FIGS. 2–4; (3) Meeting hall with at least 24 square feet for every residence in the neighborhood, labeled 2.41, 3.41, and 4.41 in FIGS. 2–4; (4) Paved plaza covering at least the same ground area as meeting hall, labeled P in FIGS. 2–4; (5) Flagpole and flag of very high quality; (6) Other commercial businesses housed in buildings adjacent to the wholesome hangout, labeled C in FIGS. 2–3; (7) optional outbuildings in addition to the garage 2.48 can also include elder cottages 2.49 and carriage houses 2.49, where an apartment sits atop the garage, each to be no larger in footprint than the usual garage for the given neighborhood.

(61) Five ancillary financial design features. Ancillary financial design features of the present invention are preferably all present unless prohibited by law or financial cost. For purposes of patent these ancillary financial design features produce added amenities falling outside the essence and definition of the preferred embodiment of the present invention to be discussed in this document. Thus the ancillary financial design features will not be discussed in detail in this document. These ancillary financial design features consist of a Neighborhood Housing Arrangement wherein it is preferred that: (1) At time of purchase all homebuyers of residences in residential (not the neighborhood center) blocks pay a "neighborhood development fee" to go into an escrow account for improvements on common land or buildings; (2) Upon sellout of any given residence block, one third or a calculated proportion of each homebuyer's neighborhood development fees becomes available for improvement of that residence block park faced by the resident. Then the homebuyers on the given block get to choose which amenities they wish to place on or in their own residence block park, subject to veto by the developer, who will encourage sweat equity "barnraising" projects such as a small playground, flower garden, or nature area. This arrangement does not apply to residences facing the neighborhood center or square, because improvements in the neighborhood center park are available to all neighborhood residents and decided by the developer after consultation with a plurality of residents; (3) Upon sellout of the neighborhood, the remainder of all neighborhood home buyers' neighborhood development fees becomes available to improve the neighborhood park (common land and common buildings, which contains at least all parks, sidewalks, plazas, and buildings), with developer holding veto power for three years after neighborhood sellout; and (4) Neighborhood development fees are not refundable but rather must fund improvements of common land or common buildings as defined just above, or be held in escrow for that same purpose at a later time. (5) The developer requires all homebuyers to sign a set of covenants designed to maintain property values. For example, homebuyers will agree to certain limitations of occupancy concerning who can live in outbuildings or carriage houses, such as immediate family or second-degree relatives as defined by State statute. Over time, residents place their own stamp upon and implement most of the ancillary financial design features.

(62) Seven ancillary social design features. Ancillary social design features of the present invention are preferably all present unless prohibited by any form of restriction. For purposes of patent these ancillary social design features produce added amenities in the form of options and choices for residents falling outside the essence and definition of the preferred embodiment of the present invention to be discussed in this document. Thus the ancillary social design features will not be discussed in detail in this document. These ancillary social design features consist of the developer providing a "social design" to help optimize neighborly community life for each homebuyer before or upon taking possession of their residence. The "social design" preferably includes a number of options and possibilities to enrich community life in categories including the developer: (1) Making every reasonable effort to provide a worthy model for establishing rituals and traditions of special occasions, such as videotaping the hammering in of the residence corner stake of a residence into the ground by the home buyer and later giving the video to the home buyer at closing, organizing welcoming potlucks for new home buyers, public ceremonies to herald major phases of construction, concerts in bandstand, and cooperative "barnraisings" to help neighbors with a project; (2) Fostering regularly occurring helpful occasions, such as setting up instant response fire, "First Responder," and EMT auxiliary units; (3) Establishing special roles and activities for children, such as manning the General Store cash register from 3:00–7:00 p.m. to learn the free enterprise system under the watchful eye of a retiree; (4) Setting up special roles and activities for elderly, such as holding on-site religious services led by lay leaders; (5) Making freely available a small library of modern materials for learning parenting, time management, stress management, coping, financial skills, communication, and other helpful skills. (6) Making freely available other useful options easily chosen in the present invention's neighborhood housing design and not easily chosen in sprawl design, such as methods for pooling resources to hire a truly world class speaker for entertainment 7:00–9:00 p.m. on Friday night, how to set up a teen center on the fields set up by and for teenagers, and how to set up a story telling center in the meeting building; and (7) Providing a handy form for conveying the "social design," which may be conveyed in the format of an old fashioned recipe box with cards and/or computer CD. Over time, residents place their own stamp upon and implement most of the social design.

(63) Three ancillary research design features. Ancillary research design features of the present invention are preferably all present unless prohibited by law or research cost. For purposes of patent these ancillary research design features produce eventual added amenities for residents and profits for the developer falling outside the essence of and definition the preferred embodiment of the present invention to be discussed in this document. Thus the ancillary research design features will not be discussed in detail in this document. These ancillary research design features consist of a Neighborhood Housing Arrangement wherein it is preferred before and after taking possession of their residence home buyers be invited to: (1) Fill out questionnaires about quality of life and quality of place; (2) Fill out questionnaires about features of the neighborhood they most like and dislike and (3) Supply suggestions to improve and refine the neighborhood design features over time.

(64) The basic features should always be present and define the design of the present invention. The ancillary design features should nearly always be present but do not define design of the present invention.

(65) Strict definitional relationship between the basic and ancillary design features of the present invention. This document concerns strict definitional relationships among features that make up the design of the present invention. The basic eight features of the present invention are always present and all together are sufficient for the design of the present invention. Unless prohibited by law, terrain, financial cost, or other restriction, the ancillary design features of the present invention will nearly always be present because they are important and highly characteristic, but ancillary design features are neither necessary nor sufficient for the design of the present invention.

(66) Relationship in practice between the basic and ancillary design features of the present invention. Implementations of the present invention in the real world may present unforeseen restrictions prohibiting or limiting the implementation of both basic and ancillary design features. For purposes of this patent, such limitations restrict the real world implementation but not the initial application attempt where all basic and ancillary design features are attempted in good faith. Thus when such an attempt is made, the result embodies the present invention. The nature of the present invention as "a Neighborhood Housing Arrangement" mandates illustration of the preferred embodiments on several building sites, because all building sites are different according to the definition of real estate. Therefore, the basic eight physical design features are illustrated in each of the four figures for the four building sites. For example each site requires a spatially different application of each feature, as when the U-shape of a block of residences is slanted due to a nearby highway or curved due to a nearby creek. Despite the spatial differences, the conceptual and functional application of the features remains unchanged. Mathematically speaking, the topology of the basic eight physical design features remains as invariant as possible. Even in such instances where the spatial features of the U-shape differ, the overall U-shape approximates a perfectly formed letter U as closely as possible within constraints of the building site.

(67) Eight basic physical design features discussed in detail.

(68) (1) A perimeter road around the outside border of the residential part of the neighborhood. In FIGS. 1, 2 and 4, the perimeter road surrounds the residential part of the neighborhood far enough to allow vehicle access to buildings either directly from the perimeter road or from the smaller back streets. Although the perimeter road might have been extended to encircle the fields and thus the entire site, it was not so extended in FIGS. 1, 2 and 4. Complete encirclement of the entire site or any portion thereof is preferred insofar as practicable in the present invention. In FIGS. 2 and 4 complete encirclement of the land tract by the perimeter road would have added prohibitively to costs, reduced the size of the fields, and brought vehicle traffic closer to fields increasing pedestrian danger and reducing beauty. In FIG. 4, complete encirclement of the land tract by the perimeter road would have destroyed the beauty of the small winding creek. In FIG. 3, the building site and arrangement of buildings required the perimeter road to encircle the entire site to provide vehicle access to all buildings.

(69) (2) Blocks of residence buildings to have a substantially U-shaped configuration surrounding and forming the outside boundary of a block park. In all three figures, blocks of residence buildings have a U-shaped configuration. In FIGS. 1 and 2, all blocks form a perfect U, because the site is defined as perfectly flat for purposes of creating a prototype. In FIG. 3, the U-shape is altered to fit the (a) slanted boundaries caused by the nearby highway going from Southwest to Northeast and (b) shorter block lengths required in the Southern area. In FIG. 3, an artist colony labeled AC was added to utilize a small protrusion of land at the far southwest corner of the site, where artisans live above their studios in adjoining townhouses. Even this artist colony approximates a U-shape as much as possible, given the need to allow very clear visual access to the art plaza retail shop area from the nearby highway. In FIG. 4, buildings grouped into U-shapes are irregular to fit the boundaries, illustrating the high degree of variation in the U-shape possible when needed to form a block.

(70) (3) Blocks of residence placed so as to back up to adjoin the perimeter road with the opening of their U-shape facing inward away from the perimeter road. All four figures show blocks of residence backing up to and adjoining the perimeter road with their U-shape opening inward away from the perimeter road and toward the inside of the neighborhood tract.

(71) (4) A plurality of residence buildings to be designed for elderly residents to guarantee a viable presence of three generations of residents. In FIG. 2, elder cottages are lined up and down the Main Street pedestrian promenade. In FIG. 4, acreage, estate zoning, and upscale site location allowed only three elder cottages shown as the small houses labeled with the numeral 4.44.

(72) (5) Every residence to enfront a semi-private space such as front porch, deck, balcony, yard, or garden. The semi-private space is normally defined as a place adjoining a residence where people can participate in community life from a position of emotional security. In functional terms the semi-private space is the most visible link between the individual residence and the outside community. In all figures, all residences and the general store have spacious front porches.

(73) (6) One block containing the neighborhood center with neighborhood park and a wholesome hangout or gathering building such as general store, coffee house, or soda shop. In FIG. 2 the southeast block contains the square or neighborhood center with a general store G and bandstand B. In FIG. 3, the area bounded by the general store G, meeting hall, and bandstand B forms the neighborhood center. In FIG. 4, the area bounded by the general store and meeting hall joined together in one building G, bandstand B, and elder cottages forms the neighborhood center. In the present invention, the wholesome hangout is expressly designed to feel comfortable for use by all three generations: Children, adults, and elderly.

(74) (7) Residence and other buildings to have vehicle access from the rear by either the perimeter road or smaller back streets so residence buildings face a neighborhood interior with no roads or vehicles but rather consisting of parks, fields, sidewalks, and other pedestrian and neighborhood amenities. In all four figures residence and other buildings have vehicle access from the rear by either the perimeter road or smaller back streets. Thus, residence buildings face a neighborhood interior with no roads or vehicles but rather consisting of parks, fields, sidewalks, and other pedestrian and neighborhood amenities. The connection to all residences by sidewalks is also essential for the present invention, as shown in all four figures.

(75) (8) Undeveloped land to remain in fields. All four figures show undeveloped land remaining in fields, which are turned over by the builder or developer to a neighborhood association at the time when the neighborhood sells mostly or all out. Neighborhood residents then have the option of putting certain highly restricted amenities on a minority of the fields. Such amenities may include day care center, teen center, sports facilities, agriculture facilities, cultural facilities, and other designated amenities for the exclusive use of residents and personal guests, not commercial uses.

(76) Optimizing basic human need for safety—The following features of the present invention optimize satisfaction of the basic human need for safety: (1) Boundaries expressly designed for safety. Satisfying the basic human need of safety requires boundaries. The classic research of Oscar Newman's (1973) *Defensible Space* as extended by Alice Coleman (1990) shows that boundaries which look as if they would be defended protect those within from crime, disturbance, and damage of the neighborhood. Throughout history human settlements have established boundaries for protection. The present invention has three layers of boundaries from the outside neighborhood into the residence plus the usual four transition zones to the front of residences: From outside the neighborhood into the residence, the present invention has three layers of boundaries: Fence or other outside boundary, perimeter road, and U-shaped blocks. A fence or other boundary preferably surrounds the neighborhood tract of the Neighborhood Housing Arrangement of the present invention around its outside border. In all figures, a fence or creek with a deep gully surrounds the neighborhood tract. The perimeter road surrounding most of the neighborhood tract adds another layer of boundary. The U-shape of residence blocks backing up to the perimeter road adds still another, smaller scale boundary. All three types of boundaries—outside fence, perimeter road, and U-shaped residence blocks—act to psychologically as well as physically deter crime and unwanted intrusion. From the front of each residence, the usual four transition zones—public, semi-public, semi-private, and private—buffer the residences of the present invention. Modern sprawl design has no definite boundaries around the outside of any defined area, while excessive distances in front of residences and absence of sidewalks usually separate residents from their neighbors. In new urbanism theory, boundaries are only occasionally mentioned and usually not linked to any purpose or function other than respecting municipal borders, historical areas, or environmental preservation. In real new urbanism neighborhoods, some sort of boundary is occasionally visible around the outside but nothing to compare with the three layers in the present invention. (2) Single or at most double entrance. The single entrance to the neighborhood tract of the Neighborhood Housing Arrangement of the present invention adds to satisfaction of safety needs. Jane Jacobs' (1961) classic phrase "eyes on the street" has come to symbolize the fundamental safety process of surveillance as a process that greatly assists safety, so much that virtually every store open all night long in the U.S. has just one clearly visible entrance open. The present invention has a single or at most double entrance to allow excellent surveillance without the need for gates. Thus all land in the neighborhood and residence blocks become highly defensible space (Newman, 1973, 1996). In all figures, the center or square of the Neighborhood Housing Arrangement is likewise situated to enjoy many lines of sight to deter crime and intrusion. (3) Unmistakable group membership and territorial control. The residents of the Neighborhood Housing Arrangement of the present invention derive further safety from membership in an unmistakably visible physical U-shaped group of residences which face each other and a surround a common territory, their residence block park. The configuration and small human scale of each U-shaped block in the present invention clearly connotes group membership and territorial control by residents. The hierarchical design of blocks together forming a unified whole adds to the sense of membership in both smaller blocks and the larger neighborhood design. In sprawl design, no visible group membership exists. In new urbanism design, no necessary comparably unmistakably visible marker of group membership exists, let alone membership in the sort of hierarchical arrangement that is designed into the present invention. Only to the extent that the developer has provided an outside boundary do sprawl and most new urbanism neighborhoods contain any defensible space. (4) Living among known neighbors upon whom one can count for assistance. Elderly residents are known to feel safer when they live among neighbors they know and can count on for assistance. Several features of the present invention promote socialization and also improve perceptions of and actual safety for residents (see section on satisfying needs for socialization below). (5) Human scale and absence of motor vehicles. The present invention's interior scaling to human pedestrians rather than to motor vehicles or large-scale acts to deter crime, acting in concert with the present invention's interior expressly designed to be vehicle free. To illustrate how smaller scale and "traffic calming" of vehicles act in concert to reduce crime, consider the very practical example of the Five Oaks area in Dayton, Ohio (Newman, 1996). This fine old neighborhood was rapidly declining under an onslaught of crime and vice, and even special police strike forces failed to halt crime. Then the police department called in Oscar Newman to apply his defensible space concepts. Newman subdivided Five Oaks into smaller, named neighborhoods, and blocked off about one-third of streets (some only gated at night) to reduce traffic. In 11 months violent crime dropped by 50%. (6) Defensible space. The present invention intentionally builds in all possible features of Oscar Newman's (1973, 1996) defensible space. In contrast to the present invention, sprawl and new urbanism design leave most defensible space considerations to chance. In their favor, good upkeep in sprawl and new urbanism design neighborhoods helps to deter crime and intrusion, but criminals still gravitate to prey on even well-kept residences lacking defensible space. To their detriment, sprawl and new urbanism designs usually ignore the whole issue of defensible space, especially the all-important, centuries old design feature of boundaries. (7) Slow and few escape routes. In the present invention, even though one can drive a vehicle out in a minute or two from anywhere inside the neighborhood tract, high speed escape for criminals is impossible, because in the present invention the escape routes are slow at about 15 miles per hour and few. Sprawl design emphasis on traffic convenience provides rapid escape routes by motor vehicle. Most new urbanism designs also provide an abundance of escape routes. When new urbanism design streets form an intricate lattice or grid of narrow streets to "filter down" traffic volume and speed, two things happen that Newman (1973, 1996) and Coleman's (1990) research shows clearly contribute to crime: First, traffic slows, which is good. Second, numerous escape routes appear, which hinders operation of defensible space and Crime Prevention Through Environmental Design principles (see paragraph (10) below). (8) Children will never get hit by a vehicle. The present invention offers something unique for families with children: Children in the interior of a Neighborhood Housing Arrangement of the present invention will never get hit or hurt by a vehicle, because there are no roads or vehicles inside the Neighborhood Housing Arrangement, which is inhabited solely by pedestrians. (9) Privacy: How features of the present invention optimize the basic human need for privacy. According to the Merriam Webster dictionary, satisfying the basic human need of privacy requires assuring "the state of being apart from company or observation." Modern psychological research (Flanders, 1982) documents the necessity to balance satisfying needs for both privacy and human contact or socialization. Too much privacy breeds isolation, loneliness, and maladjustment, while too much socialization robs the individual of internalized identity and needed solitude. Optimal satisfaction of the need for socialization allows the neighborhood resident ready and convenient access to spaces that by their design passively facilitate both (a) privacy away from undesired company as well as (b) socializing with desired company. Inside this invention's Neighborhood Housing Arrangement one can attain privacy in one of two ways: Retreat into residence and walk to nearby park or fields: (a) Retreat into residence. The present invention provides and clearly demarcates the four time-honored hierarchy of zones in transition from private to public spaces: Private (interior of residence or fenced patio), semi-private (porches, decks, balconies, front yards, front gardens, where people can participate in community life from a position of emotional security), semi-public (sidewalks, internal passages, and courts, all provisionally open to the general public but psychologically owned by the residents), and public (streets, public buildings). The relatively compact human or pedestrian scale inherent in the design of the present invention allows for convenient and comfortable retreat into the private area. The retreat is comfortable, because the private area borders so closely the semi-public sidewalk. Thus in the present invention one can readily and conveniently attain privacy while viewing a neighborhood that clearly invites and facilitates but does not demand socialization. One can comfortably and conveniently attain the balance needed for privacy. In general new urbanism design neighborhoods one can readily enter one's residence, but attaining the balance is more difficult than in the present invention. In new urbanism design, seeking privacy would appear convenient on the surface, because new urbanism designs usually contain the four transition zones and residences have short setbacks leading to sidewalks. By virtue of physical design of the individual residence new urbanism design appears to offer excellent opportunities to attain privacy, but such opportunities fall far short of those in the present invention, because the present invention's overall block and neighborhood layout provides far more possibilities for neighborly socialization. The need to look with wide angle perspective beyond nice-looking individual residences and include the block and neighborhood layout is subtle but crucial, illustrating the benefits of taking the systems view of human behavior at differing levels of analysis advocated by James G. Miller (1978) in his *Living Systems* and Flanders (1982). The present invention contains a physical design to optimize satisfaction of socialization needs in at least three (of seven) levels of analysis according to Miller (1978): The individual person, the small (family, kinship, friendship) group, and (neighborhood) organization. Thus, in new urbanism design, opportunities for privacy are nowhere near as convenient as in the present invention (see section on socialization below), so the balance is far more difficult to attain. In sprawl design one can easily enter one's residence, but opportunities for neighborly socialization are sorely lacking, as documented by virtually the entire new urbanist literature (e.g. Kunstler, 1996), so the balance is quite difficult to attain. (b) Walk to nearby park or fields. The present invention is the only neighborhood design where one can always walk a few hundred feet to the fields and truly get away from people for some privacy. New urbanism design mandates open space but not fields. In new urbanism designs only occasionally can one take a short walk to get privacy in the minority of new urbanism neighborhoods with fields. In most new urbanism designs the open space usually takes the form of plazas, pocket parks, and other urban amenities that provide mainly socialization, not privacy. In most sprawl design not even open space is mandated, so attaining privacy is achieved only through going inside a residence or leaving the residential area by vehicle. In sprawl if one walks a few hundred feet, one lands on the neighbor's property or in the street, because that is usually all there is in residential sprawl. Sprawl rarely contains any open space to which one can walk. (10) Crime Prevention Through Environmental Design or CPTED. The present invention intentionally builds in the main features of CPTED. CPTED has become the standard doctrine of most governments and police forces in the civilized world, including the U.S. Federal HUD and the National Crime Prevention Council in the U.S. CPTED boils defensible space down into simple principles residents can understand and apply. The National Crime Prevention Council (2002) promotes four principles of CPTED quoted here verbatim: "Territoriality: People protect territory that they feel is their own and have a certain respect for the territory of others. Fences, pavement treatments, art, signs, good maintenance, and landscaping are some physical ways to express ownership. Identifying intruders is much easier in a well-defined space. [The present invention's design is expressly planned to accomplish exactly these goals with its three layers of boundaries and clearly demarcated transition zones.] Natural Surveillance: Criminals don't want to be seen. Placing physical features, activities, and people in ways that maximize the ability to see what's going on discourages crime. Barriers, such as bushes, sheds, or shadows, make it difficult to observe activity. Landscaping and lighting can be planned to promote natural surveillance from inside a home or building and from the outside by neighbors or people passing by. Maximizing the natural surveillance capability of such 'gatekeepers' as parking lot attendants and hotel desk clerks is also important. [The present invention's design is expressly planned to accomplish exactly these goals with intentionally maximized eyes on the street.] Activity support: Encouraging legitimate activity in public spaces helps discourage crime. A basketball court in a public park or community center will provide recreation for youth, while making strangers more obvious and increasing active natural surveillance and the feeling of ownership. Any activity that gets people out and working together—a clean-up day, a block party, a Neighborhood Watch group, a civic meeting—helps prevent crime. [The section on socialization below shows how the present invention's design is expressly planned to accomplish exactly these goals.] Access control: Properly located entrances, exits, fencing, landscaping, and lighting can direct both foot and automobile traffic in ways that discourage crime. Access control can be as simple as a neighbor on the front porch or a front office. Other strategies include closing streets to through traffic or introducing neighborhood-based parking stickers." [The present invention is expressly planned to accomplish exactly these goals by expressly designing semi-private spaces in front of all residences, and slow and few escape routes.]

(77) The following features of the present invention optimize the basic human need for peace and beauty: Satisfying the basic human need for peace and beauty requires building a neighborhood combining safety and beauty as judged by a majority of residents. In the 19th and early 20th Centuries, proponents of the Arts and Crafts and Garden City Movements including William Morris, Ebenezer Howard (1898), and Raymond Unwin (1909) explicitly designed natural beauty into their plans, believing that natural beauty promoted health including and even emphasizing benefits upon one's physical medical health. Many lines of reason and evidence point to village design possessing more beauty—and thus greater preference—than sprawl design. Nelessen's (1994) extensive and often repeated research shows raters like and prefer all village and new urbanism features over sprawl features using objective ratings of photographs. Americans spend billions each year to just mingle in European village style settings, not post World War II European suburban sprawl. Assuming that American holiday cards show beauty, Americans buy holiday cards showing village housing, not sprawl. Parenthetically but not unrelated to the design of the present invention, peace and beauty are once again beginning to get medical attention. Hospital inpatients have slightly but reliably shorter stays and quicker recoveries when their hospital room faces and shows some green vegetated space. Research studies have documented favorable health and experiential effects for office workers who look out upon some green space. Modern researchers are rediscovering the wisdom of the 19th Century thinkers and builders. The present invention's basic design features provide far more than other designs by incorporating the eight basic physical design features, most ancillary features, and most new urbanism features and siting every residence to face a park immediately in front of it—an amenity no other design has. The present invention removes the ugly pavement from in front of sprawl and new urbanism design residences and replaces it with green space. Further, the present invention provides fields in every neighborhood, not just some, as new urbanism. Thus in satisfying needs for peace and beauty, the present invention offers far more than new urbanism design, which towers over sprawl in this category.

(78) The following features of the present invention optimize the basic human need for socialization: Satisfying the basic human need for socialization requires providing perceptual and actual ready access for making acquaintances and building bonds of neighborly friendship. (1) The present invention's safety features provide the essential security for residents to venture out and have a life in public. The present invention's superior provisions for safety thus have the added effect of enhancing socialization. The present invention's perimeter road promotes socialization within the neighborhood to a greater degree than in sprawl design without boundaries and also in new urbanism design that has no special boundary design for safety. (2) The present invention's U-shaped blocks promote socialization by instantly placing new residents in an unmistakable physical grouping of residences that face each other and a common territory, the block park. No other design offers instant group membership of this sort. (3) The present invention supplies every residence with the four transition zones (private, semi-private, semi-public, public), which not only protect privacy but also ease one out into the public zones for socialization if one so desires. The extremely handy presence of all four transition zones in the absence of usually noisy and often deadly vehicular traffic allows the four time-honored transition zones to function far better than in the other two available designs. In sprawl the semi-private and semi-public zones are usually non-existent. (4) The present invention's provision of not only a neighborhood center but also a wholesome hangout enhances socialization. In his classic sociological treatise, *The Great Good Place*, Dr. Ray Oldenburg (1989) makes a compelling case for wholesome gathering places in the public realm being near-universal throughout history, healthy for community residents satisfying basic socialization needs, and even essential for great civilizations. Sprawl design altogether omits neighborhood centers and wholesome hangouts. The very term "sprawl" means to spread out with insufficient organization, regularity, or pattern including centers for organized socialization. Statements of new urbanism principles give much attention to the neighborhood center but fail to specify the wholesome gathering place as essential. To their credit, most new urbanism neighborhoods in practice have one or more gathering places, but the nature of those gathering places derives from the developer, not new urbanism per se or its theory. (5) The present invention draws people out their front door. The present invention's placement of roads in back and all manner of highly attractive amenities in pedestrian areas and parks in front of residences has the subtle but powerful effect of drawing residents out their front doors. Once a resident gets out onto the porch or sidewalk, the inviting human scale pedestrian environment creates an atmosphere of peace and beauty focusing on people rather than an impersonal environment focusing on vehicles or dodging them. Sprawl design offers little to draw residents out the front door, because sprawl lacks the transition zones and socially attractive amenities out front. Quite to the contrary, in sprawl design most attractive amenities are inside or behind the residence, a minimal provision present in all housing designs. New urban design usually offers the four transition zones, lacks the totally pedestrian environment, has a human scale, sometimes has a neighborhood park, lacks block parks, and is laced throughout with small streets which distracts attention away from people toward vehicles to avoid those vehicles. (6) The present invention greatly eases socialization by expressly including housing for the two categories of persons easiest to approach, children and elderly citizens. Residences for elderly citizens comprise necessary feature number four of the present invention, and the overall layout of the present Neighborhood Housing Arrangement will clearly attract families with children. Further, children and elderly citizens attract each other under safe and pleasant conditions, clearly present in the present invention. (7) The present invention solves the age-old problem of mixing traffic and people in residential neighborhoods. No design has ever done this. Sprawl design fails to take the problem seriously and arranges the neighborhood to give vehicles supremacy over the convenience and safety of pedestrians and their basic human needs, an arrangement appropriate for manufacturing districts but not residential neighborhoods. New urbanism design simply dilutes vehicle flow, but with high densities of vehicles in popular new urbanist communities, even the smaller streets clog up with congestion, blocking socialization. New urbanism design also fails to solve the problem of providing safety from vehicles. Even though vehicles travel at slower speeds in new urbanism design, shorter setbacks place pedestrians much closer to vehicles, so safety suffers. The present invention has finally solved the problem of mixing vehicles and people in residential neighborhoods in a genuinely new way.

(79) While particular embodiments of the present invention have been described in detail, it is apparent that adaptations and modifications to fit real world constraints may be made in practice without departing from the true spirit and scope of the invention as set forth in the claims.

What is claimed is:

1. A Neighborhood Housing Arrangement comprising:

(a) a neighborhood tract having an entrance;

(b) a road within said neighborhood tract extending from said entrance of said neighborhood tract;

(c) a neighborhood park within said neighborhood tract;

(d) a neighborhood center block within said neighborhood tract; said neighborhood center block including a plurality of neighborhood center block building lots; each of said neighborhood center block building lots having a rear border adjacent said road and having a front border adjacent said neighborhood park; and (e) a residence block within said neighborhood tract; said residence block including a plurality of residence block building lots; each of said residence block building lots having a rear border adjacent said road and having a front border adjacent said neighborhood park;

said road including a perimeter road extending from said entrance of said neighborhood tract around at least a portion of the perimeter of said neighborhood tract, and one or more back streets extending from said perimeter road to said rear border of any of said block building lots that is not adjacent said perimeter road.

2. A Neighborhood Housing Arrangement comprising:

(a) a neighborhood tract having an entrance;

(b) a road within said neighborhood tract extending from said entrance of said neighborhood tract;

(c) a neighborhood park within said neighborhood tract;

(d) a neighborhood center block within said neighborhood tract; said neighborhood center block including a plurality of neighborhood center block building lots; each of said neighborhood center block building lots having a rear border adjacent said road and having a front border adjacent said neighborhood park;

(e) a residence block within said neighborhood tract; said residence block including a plurality of residence block building lots; each of said residence block building lots having a rear border adjacent said road and having a front border adjacent said neighborhood park;

(f) a neighborhood center on at least one of said neighborhood center block building lots; and (h) a residence building on at least one of said residence block building lots; said residence building having a front side adjacent said front border of said residence block building lot, a rear side adjacent said rear border of said residence block building lot, and a semi-private space adjacent said front side thereof.

3. The Neighborhood Housing Arrangement of claim 2 in which said residence block is arranged to have a substantially U-shaped configuration with an opened mouth; and in which said neighborhood park includes a peninsular-like area extending into said opened mouth of said residence block.

4. A Neighborhood Housing Arrangement comprising:

(a) a neighborhood tract having an entrance;

(b) a road within said neighborhood tract extending from said entrance of said neighborhood tract;

(c) a neighborhood park within said neighborhood tract;

(d) a neighborhood center block within said neighborhood tract; said neighborhood center block including a plurality of neighborhood center block building lots; each of said neighborhood center block building lots having a rear border adjacent said road and having a front border adjacent said neighborhood park;

(e) a neighborhood center on at least one of said neighborhood center block building lots;

(f) a plurality of residence blocks within said neighborhood tract; each of said residence blocks including a plurality of residence block building lots; each of said residence block building lots having a rear border adjacent said road and having a front border adjacent said neighborhood park;

(g) a residence building on at least a plurality of said residence block building lots;

a plurality of said residence blocks being arranged to have a substantially U-shaped configuration with an opened mouth; and said neighborhood park including a peninsular-like area extending into said opened mouth of each of said residence blocks arranged to have a substantially U-shaped configuration.

5. A Neighborhood Housing Arrangement comprising:

(a) a neighborhood tract having an entrance;

(b) a road within said neighborhood tract extending from said entrance of said neighborhood tract;

(c) a neighborhood park within said neighborhood tract;

(d) a neighborhood center block within said neighborhood tract; said neighborhood center block including a plurality of neighborhood center block building lots; each of said neighborhood center block building lots having a rear border adjacent said road and having a front border adjacent said neighborhood park;

(e) a neighborhood center on at least one of said neighborhood center block building lots;

(f) a plurality of residence blocks within said neighborhood tract; each of said residence blocks including a plurality of residence block building lots; each of said residence block building lots having a rear border adjacent said road and having a front border adjacent said neighborhood park; and (g) a residence building on at least a plurality of said residence block building lots;

said road including a perimeter road extending from said entrance of said neighborhood tract around at least a portion of the perimeter of said neighborhood tract, and back streets extending from said perimeter road to said rear border of any of said block building lots that is not adjacent said perimeter road.

6. A Neighborhood Housing Arrangement comprising:

(a) a neighborhood tract having an entrance;

(b) a road within said neighborhood tract extending from said entrance of said neighborhood tract;

(c) a neighborhood park within said neighborhood tract;

(d) a neighborhood center block within said neighborhood tract; said neighborhood center block including a plurality of neighborhood center block building lots; each of said neighborhood center block building lots having a rear border adjacent said road and having a front border adjacent said neighborhood park;

(e) a neighborhood center on at least one of said neighborhood center block building lots;

(f) a plurality of residence blocks within said neighborhood tract; each of said residence blocks including a plurality of residence block building lots; each of said residence block building lots having a rear border adjacent said road and having a front border adjacent said neighborhood park; and (g) a residence building on at least a plurality of said residence block building lots; each of said residence buildings having a front side adjacent said front border of one of said residence block building lot, a rear side adjacent said rear border of said one of said residence block building lot, and a semi-private space adjacent said front side thereof.

7. A Neighborhood Housing Arrangement comprising:

(a) a neighborhood tract having an entrance;

(b) a perimeter road extending from said entrance of said neighborhood tract around said neighborhood tract;

(c) a plurality of back streets extending from said perimeter road into said neighborhood tract;

(d) a neighborhood park within said neighborhood tract, said neighborhood park having a plurality of peninsular-like areas;

(e) a neighborhood center block within said neighborhood tract; said neighborhood center block including a plurality of neighborhood center block building lots; each of said neighborhood center block building lots having a rear border adjoining at least one of said roads and having a front border adjoining said neighborhood park;

(f) a neighborhood center on one of said neighborhood center block building lots;

(g) a plurality of residence blocks within said neighborhood tract; each of said residence blocks being arranged to have a substantially U-shaped configuration with an opened mouth receiving one of said peninsular-like areas of said neighborhood park; each of said residence blocks including a plurality of residence block building lots; each of said residence block building lots having a rear border adjoining one of said roads and having a front border adjoining said neighborhood park; and (h) a plurality of residence buildings; each of said residence buildings having a front side, a rear side, and a semi-private space adjacent said front side thereof; each of said residence buildings being built on one of said building lots with said front side thereof adjacent said front border of said building lot and with said rear side thereof adjacent said rear border of said building lot.

8. A Neighborhood Housing Arrangement comprising:

(a) a neighborhood tract having an entrance;

(b) a road within said neighborhood tract extending from said entrance of said neighborhood tract;

(c) a neighborhood park within said neighborhood tract; said neighborhood park including a peninsular-like area;

(d) a U-shaped residence block within said neighborhood tract; said U-shaped residence block having an opened mouth with said peninsular-like area of said neighborhood park extending into said opened mouth; said U-shaped residence block including a plurality of residence block building lots; each of said residence block building lots having a rear border adjacent said road and having a front border adjacent said neighborhood park; and (e) a residence building on at least one of said residence block building lots; said residence building having a front side adjacent said front border of said residence block building lot, and a rear side adjacent said rear border of said residence block building lot.

9. A Neighborhood Housing Arrangement comprising:

(a) a neighborhood tract having an entrance;

(b) a road within said neighborhood tract extending from said entrance of said neighborhood tract;

(c) a neighborhood park within said neighborhood tract;

(d) a neighborhood center block within said neighborhood tract; said neighborhood center block including a neighborhood center block building lot having a rear border adjacent said road and having a front border adjacent said neighborhood park;

(e) a neighborhood center on said neighborhood center block building lot;

(f) a plurality of residence blocks within said neighborhood tract; each of said residence blocks including a plurality of residence block building lots; each of said residence block building lots having a rear border adjacent said road and having a front border adjacent said neighborhood park; and (g) a residence building on at least a plurality of said residence block building lots; each of said residence buildings having a front side adjacent said front border of one of said residence block building lot, and a rear side adjacent said rear border of said one of said residence block building lot.

* * * * *